US009200602B2

(12) United States Patent
Ogawa

(10) Patent No.: US 9,200,602 B2
(45) Date of Patent: Dec. 1, 2015

(54) PRESSURE REGULATOR

(75) Inventor: Yoshihide Ogawa, Anjo (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 631 days.

(21) Appl. No.: 13/519,194

(22) PCT Filed: May 27, 2011

(86) PCT No.: PCT/JP2011/062289
§ 371 (c)(1),
(2), (4) Date: Jun. 26, 2012

(87) PCT Pub. No.: WO2012/164650
PCT Pub. Date: Dec. 6, 2012

(65) Prior Publication Data
US 2012/0298075 A1 Nov. 29, 2012

(51) Int. Cl.
*F02M 37/00* (2006.01)

(52) U.S. Cl.
CPC ..... *F02M 37/0029* (2013.01)

(58) Field of Classification Search
CPC ..... F02M 37/0029; F02M 37/0052; F02M 69/54; F02M 37/0023
USPC ..... 123/457, 459, 460, 510, 511, 514; 137/505–505.47, 510
See application file for complete search history.

(56) References Cited

U.S. PATENT DOCUMENTS 4,364,369 A * 12/1982 Nomura et al. ..... 123/568.18
4,604,979 A * 8/1986 Kobayashi et al. ..... 123/449
4,660,597 A * 4/1987 Cowles ..... 137/505.42
5,220,941 A * 6/1993 Tuckey ..... 137/510
5,265,644 A * 11/1993 Tuckey ..... 137/510
5,372,159 A * 12/1994 Ziegelmeyer et al. ... 137/505.14
6,056,009 A * 5/2000 Powell et al. ..... 137/505.42
6,782,871 B2 * 8/2004 McIntyre et al. ..... 123/457
7,404,388 B2 * 7/2008 Bang ..... 123/198 D
7,874,284 B2 * 1/2011 Sano ..... 123/511
8,276,568 B2 * 10/2012 Takagi et al. ..... 123/511

(Continued)

FOREIGN PATENT DOCUMENTS

JP 63088269 A * 4/1988 ..... F02M 69/00
JP 63120856 A * 5/1988 ..... F02M 69/00

(Continued)

OTHER PUBLICATIONS

International Search Report of PCT/JP2011/062289 mailed Jul. 26, 2011.

*Primary Examiner* — Thomas Moulis
*Assistant Examiner* — Joseph Dallo
(74) *Attorney, Agent, or Firm* — Kenyon & Kenyon LLP

(57) ABSTRACT

A pressure regulator is connected to a fuel pipe to which fuel is supplied by a feed pump. There is formed a fuel channel in the pressure regulator for returning fuel from within the fuel pipe to the fuel tank. In the pressure regulator, there are also formed a stopper and a valve body which collectively reduce the fuel flow area of the fuel channel as a result of an increase in the fuel pressure within the fuel pipe. This makes the fuel within the fuel pipe less likely to be released through the aforementioned fuel channel. For this reason, it is possible to correspondingly increase the fuel pressure within the fuel pipe in an efficient manner by increasing operating rate of the feed pump under conditions where the fuel pressure within the fuel pipe is high.

3 Claims, 3 Drawing Sheets

(56) References Cited

U.S. PATENT DOCUMENTS

| | | | | |
|---|---|---|---|---|
| 2002/0073976 | A1* | 6/2002 | Leung et al. | 123/533 |
| 2003/0164161 | A1* | 9/2003 | Usui et al. | 123/510 |
| 2003/0217735 | A1* | 11/2003 | Onishi et al. | 123/458 |
| 2004/0069349 | A1* | 4/2004 | Wynn et al. | 137/505.25 |
| 2004/0177884 | A1* | 9/2004 | Konishi | 137/540 |
| 2007/0272217 | A1* | 11/2007 | Kubota et al. | 123/495 |
| 2009/0056817 | A1* | 3/2009 | Almaraz et al. | 137/505 |
| 2009/0071444 | A1* | 3/2009 | Takagi et al. | 123/447 |
| 2009/0151699 | A1* | 6/2009 | Honda et al. | 123/457 |
| 2009/0151703 | A1* | 6/2009 | Ikeya | 123/506 |
| 2011/0186018 | A1* | 8/2011 | Inoue | 123/514 |

FOREIGN PATENT DOCUMENTS

| | | | | | |
|---|---|---|---|---|---|
| JP | 04005467 | A | * | 1/1992 | F02M 57/02 |
| JP | 07-293380 | A | | 11/1995 | |
| JP | 2001-099027 | A | | 4/2001 | |
| JP | 2003-322266 | A | | 11/2003 | |
| JP | 2009-108684 | A | | 5/2009 | |
| JP | 2009-209876 | A | | 9/2009 | |

* cited by examiner

PRESSURE REGULATOR

This is a 371 national phase application of PCT/JP2011/062289 filed 27 May 2011, the contents of which are incorporated by reference.

FIELD OF THE INVENTION

The present invention relates to a pressure regulator.

BACKGROUND OF THE INVENTION

The fuel supply system for an internal combustion engine mounted on an automobile is provided with a pump and a pressure regulator. The pump feeds fuel to a fuel injection valve through a fuel pipe upon pumping the fuel from within a fuel tank. The pressure regulator prevents an excessive increase in fuel pressure within the fuel pipe that is regulated by operating the pump. One known example of this kind of pressure regulator is described in Patent Document 1.

The pressure regulator has a fuel channel for returning the fuel from within the fuel pipe back to the fuel tank. Also, the pressure regulator is provided with a moving part, which is displaced by force produced by the fuel pressure within the fuel pipe. The pressure regulator varies the flow rate of the fuel in accordance with the position of the moving part when the fuel is returned from the fuel pipe to the fuel tank through the fuel channel. Specifically, the amount of fuel that flows from the fuel pipe to the fuel tank through the fuel channel is increased by a displacement of the moving part caused by an increase in the fuel pressure within the fuel pipe.

In the event of an excessive increase in the fuel pressure within the fuel pipe that is regulated by operating the pump, provision of the aforementioned pressure regulator in the fuel supply system serves to increase the flow rate of the fuel that flows from the fuel pipe to the fuel tank through the fuel channel as a result of the displacement of the moving part caused by the increase in the fuel pressure, thereby, preventing excess increase in fuel pressure within the fuel pipe.

PRIOR ART DOCUMENT

Patent Document

Patent Document 1

Japanese Laid-Open Patent Publication No. 2001-99027

SUMMARY OF THE INVENTION

Problems that the Invention is to Solve

If it is intended to promote atomization of fuel to be sprayed from the fuel injection valve in order to produce satisfactory combustion of the fuel or to increase the amount of fuel to be sprayed from the fuel injection valve in order to raise engine output, it is preferable to increase the fuel pressure within the fuel pipe. However, even if an attempt is made to increase fuel delivery rate of the pump by increasing pump operating rate with the intent to increase the fuel pressure within the fuel pipe, it is impossible to correspondingly increase the fuel pressure within the fuel pipe in an efficient manner.

This relates to the fact that the higher the fuel pressure within the fuel pipe, the more difficult it becomes to supply the fuel from the pump to the fuel pipe and the easier it becomes for the fuel within the fuel pipe to flow from the fuel channel of the pressure regulator to the fuel tank. Incidentally, a solid line of FIG. 7 indicates a relationship between the fuel pressure within the fuel pipe and the flow rate of the fuel fed from the pump to the fuel pipe under conditions where the pump operating rate is constant, whereas a broken line of FIG. 7 indicates a relationship between the fuel pressure within the fuel pipe and the flow rate of the fuel returned from the fuel pipe to the fuel tank through the fuel channel of the pressure regulator under conditions where the pump operating rate is constant.

As will be understood from FIG. 7, the higher the fuel pressure within the fuel pipe, the lower the flow rate of the fuel (solid line) fed from the pump to the fuel pipe and the higher the flow rate of the fuel (broken line) returned from the fuel pipe to the fuel tank through the fuel channel of the pressure regulator under conditions where the pump operating rate is constant. In other words, the higher the fuel pressure within the fuel pipe, the more difficult it becomes to supply the fuel to the fuel pipe and the easier it becomes for the fuel within the fuel pipe to flow from the fuel channel of the pressure regulator to the fuel tank as mentioned above. Therefore, when the fuel pressure within the fuel pipe is already high, an increase in the pump operating rate does not contribute significantly to an increase in the fuel pressure within the fuel pipe even if the pump operating rate is raised in order to increase the fuel pressure within the fuel pipe, and it follows that the fuel pressure within the fuel pipe cannot be efficiently increased.

An attempt to increase the fuel pressure within the fuel pipe under such circumstances would make it necessary to operate the pump under conditions where the pump operating rate has been further increased, and this would inevitably result in an increase in energy consumption. There is also a possibility that the aforementioned pump needs to be increased in size in order to increase the fuel delivery rate of the pump.

The present invention has been made in light of the aforementioned circumstances. Accordingly, it is an objective of the invention to provide a pressure regulator that makes it possible to correspondingly increase the fuel pressure within a fuel pipe in an efficient manner when an attempt is made to increase fuel delivery rate of a pump by increasing pump operating rate under conditions where the fuel pressure within the fuel pipe is high.

Means for Solving the Problems

In accordance with a first aspect of the present invention, a pressure regulator including a moving part and a stopper is provided. The moving part is displaced by force produced by fuel pressure within a fuel pipe that is regulated by operating a pump. When fuel is released from within the fuel pipe through a fuel channel, the flow rate of the released fuel is varied in accordance with the position of the moving part. The stopper can come into contact with the moving part when the moving part is displaced as a result of an increase in the fuel pressure. The stopper reduces fuel flow area of the fuel channel as a result of a displacement of the moving part caused by an increase in the fuel pressure. Therefore, when the fuel pressure within the fuel pipe is high, the fuel flow area of the aforementioned fuel channel is reduced as described above, and this makes it possible to decrease the flow rate of the fuel when the fuel within the fuel pipe is released through the fuel channel. In other words, the fuel within the fuel pipe becomes less likely to be released through the fuel channel. As the fuel within the fuel pipe becomes less likely to be released through the fuel channel as stated above, it is possible to correspondingly increase the fuel pressure within the fuel pipe in an efficient manner when an attempt is made to increase fuel delivery rate of the pump by increasing operating rate of the pump under conditions where the fuel pressure within the fuel pipe is high.

In the above described pressure regulator, a passage, which constitutes a part of the fuel channel, may be formed inside the moving part, and the stopper may be provided downstream of the passage. In this case, the stopper reduces a fuel flow area of a downstream portion of the passage of the fuel channel when the moving part is displaced as a result of an increase in the fuel pressure. The passage of the moving part is provided with a constriction for reducing the fuel flow area through which the fuel passes. With the constriction formed in the aforementioned passage of the moving part as stated above, the flow rate of the fuel that flows from within the fuel pipe through the fuel channel decreases and, therefore, the fuel pressure within the fuel pipe increases with good responsiveness when the operating rate of the pump is increased.

Also, the above described stopper may provided downstream of the passage and include a facing surface, which faces a downstream opening of the passage. In this case, the distance between the downstream opening of the passage and the facing surface is decreased when the moving part is displaced as a result of an increase in the fuel pressure, thereby reducing fuel flow area of a downstream portion of the passage of the fuel channel. With this arrangement, the fuel flow area of the downstream portion of the aforementioned passage of the fuel channel is reliably reduced in the event of the aforementioned displacement of the moving part.

DETAILED DESCRIPTION OF THE PREFERRED EMBODIMENTS

A pressure regulator according to one embodiment of the present invention will now be described with reference to FIGS. 1 to 6. The pressure regulator is provided in a fuel supply system of an engine for an automobile.

Figure 1:
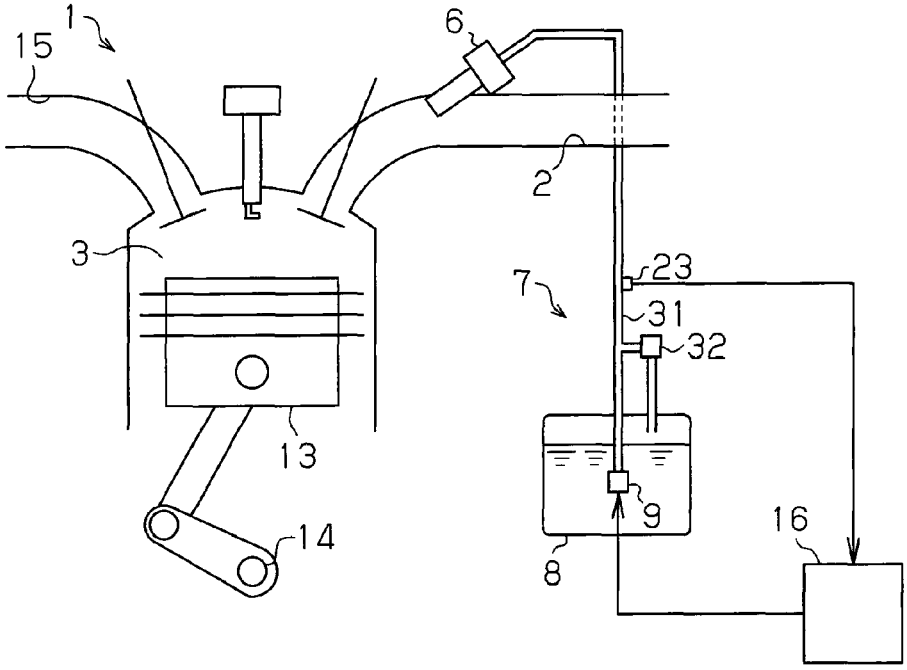
FIG. 1 is a schematic diagram depicting a fuel supply system in which a pressure regulator according to the present embodiment is provided and an engine in which the fuel supply system is provided.

In an engine 1 as depicted in FIG. 1, a mixture of air flows through an intake passage 2 and fuel sprayed from an injector (fuel injection valve) 6 is charged into a combustion chamber 3, and a crankshaft 14 rotates as a piston 13 reciprocates as a result of combustion of this mixture. Thereafter, the mixture after combustion is discharged therefrom to an exhaust passage 15 as exhaust. Also, the engine 1 is provided with a fuel supply system 7 for feeding fuel to the aforementioned injector 6. The fuel supply system 7 is provided with a feed pump 9 for pumping fuel stored in a fuel tank 8, a fuel pipe 31 for conveying the fuel pumped by the feed pump 9 to the injector 6 and a pressure regulator 32 for preventing an excessive increase in fuel pressure within the fuel pipe 31.

In the aforementioned fuel supply system 7, the fuel pressure within the fuel pipe 31 is regulated by controllably operating the feed pump 9 by means of an electronic control unit 16. Connected to the electronic control unit 16 is a pressure sensor 23, which detects the fuel pressure within the fuel pipe 31. The electronic control unit 16 controllably operates the feed pump 9 such that the fuel pressure detected by the pressure sensor 23 matches a target value that is set in accordance with engine operating conditions and the like. Specifically, controlled operation of the feed pump 9 is performed by varying operating rate of the feed pump 9 to thereby control fuel delivery rate of the pump 9.

Figure 2:
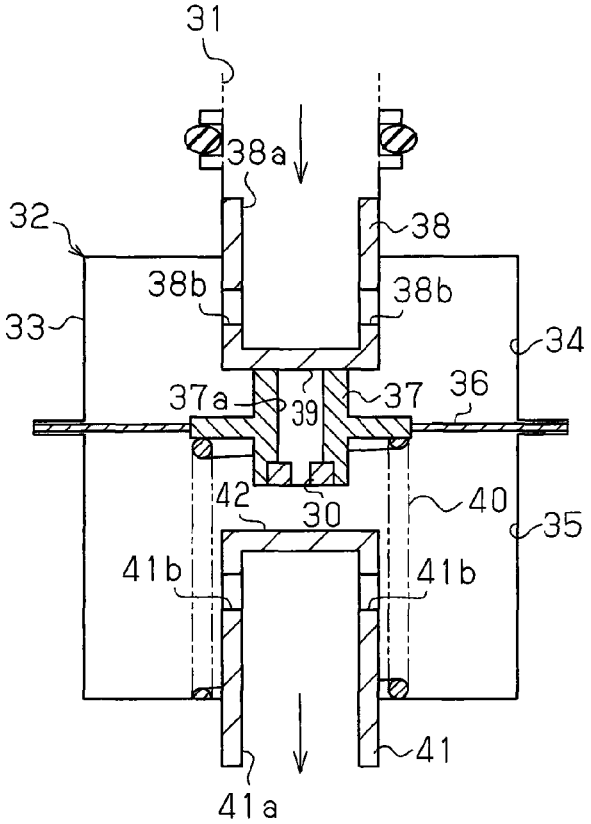
FIG. 2 is a schematic diagram depicting the structure of the pressure regulator.
Figure 3:
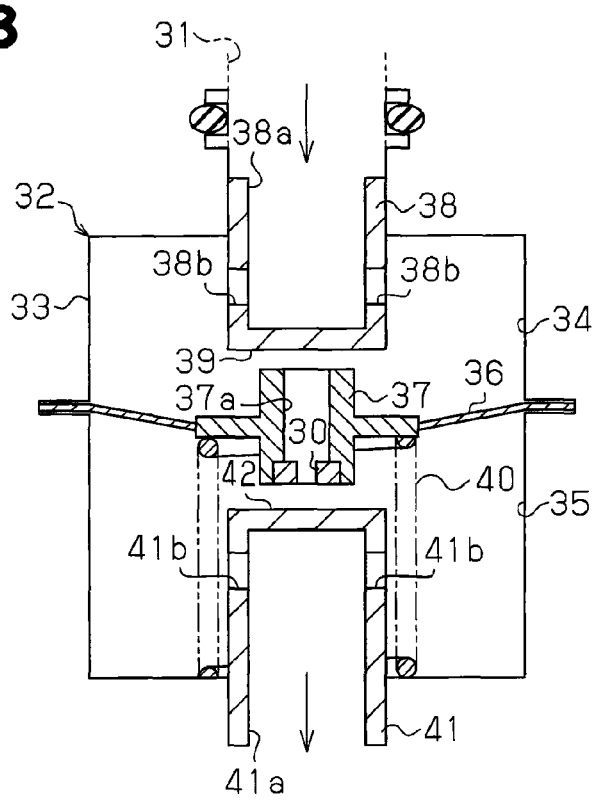
FIG. 3 is a schematic diagram depicting a state in which a valve body of the pressure regulator is displaced.
Figure 4:
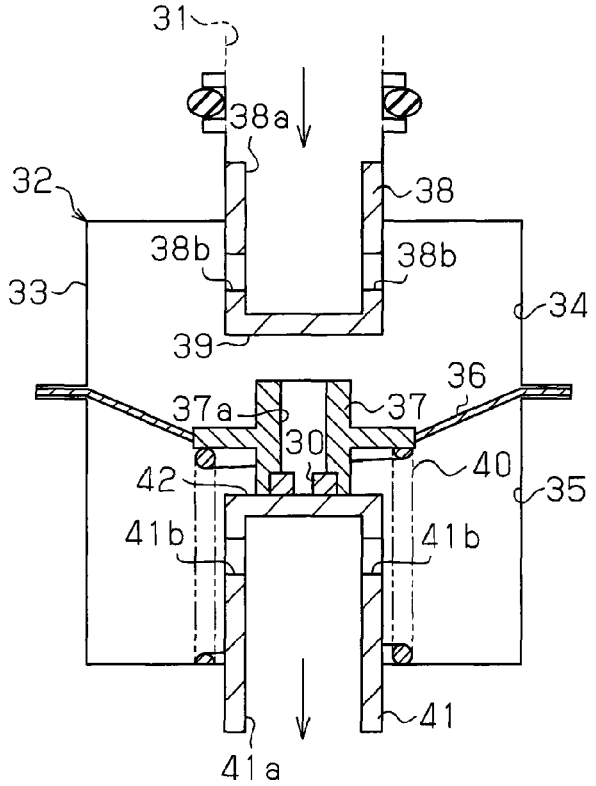
FIG. 4 is a schematic diagram depicting a state in which the valve body of the pressure regulator is displaced.

Described next with reference to FIGS. 2 to 4 is the detailed structure of the pressure regulator 32 of the fuel supply system 7 and operation of the pressure regulator 32.

As depicted in FIG. 2, the pressure regulator 32 is provided with a diaphragm 36 which partitions an internal space of a case 33 into a high-pressure chamber 34 and a low-pressure chamber 35. At a central part of the diaphragm 36, there is fixed a valve body 37, which serves as a moving part that can be displaced as a result of elastic deformation of the diaphragm 36. There is formed a passage 37*a* in the valve body 37 for interconnecting the high-pressure chamber 34 and the low-pressure chamber 35.

In a portion of the case 33 that is located in the high-pressure chamber 34 and faces the aforementioned valve body 37, a cylindrical element 38 is fixed in the case 33 by press-fitting an outer surface of the cylindrical element 38 into the case 33. An end portion of the cylindrical element 38 outside the case 33 forms an inlet port 38*a*, which communicates with the fuel pipe 31. In a portion of the aforementioned cylindrical element 38 located inside the case 33, there are formed holes 38*b* extending in a radial direction of the cylindrical element 38. An internal space of the cylindrical element 38 is connected to the high-pressure chamber 34 by these holes 38*b*. For this reason, part of the fuel within the fuel pipe 31 is introduced into the high-pressure chamber 34 through the inlet port 38*a* and the holes 38*b* of the cylindrical element 38.

An end portion of the cylindrical element 38 located inside the case 33 is in a state in which this end portion is closed off by a valve seat 39, which is in contact with the valve body 37. The aforementioned valve body 37 is pressed against the valve seat 39 by an urging force of a coil spring 40 provided in the low-pressure chamber 35 and an elastic force of the aforementioned diaphragm 36. When the valve body 37 is in contact with the valve seat 39, the fuel within the high-pressure chamber 34 is inhibited from flowing into the passage 37*a* in the valve body 37. The valve body 37 is acted upon by a force produced by a fuel pressure within the high-pressure chamber 34 (the fuel pressure within the fuel pipe 31). When the force produced by the aforementioned fuel pressure acting on the valve body 37 becomes higher than a total value of the urging force of the coil spring 40 and the elastic force of the diaphragm 36, the valve body 37 is displaced toward the low-pressure chamber 35 owing to the force produced by the aforementioned fuel pressure and becomes separated from the valve seat 39 as depicted in FIG. 3, for example. At this time, the fuel within the high-pressure chamber 34 is allowed to flow into the passage 37*a* in the valve body 37. Consequently, the fuel within the high-pressure chamber 34 flows into the low-pressure chamber 35 through the aforementioned passage 37*a*. Within the passage 37*a* in the valve body 37, there is formed a constriction 30 for reducing a flow area through which the fuel passes.

In a portion of the case 33 that is located in the low-pressure chamber 35 and faces the aforementioned valve body 37, a cylindrical stopper 41 is fixed in the case 33 by press-fitting an outer surface of the stopper 41 into the case 33. An end portion of the stopper 41 located outside the case 33 forms an outlet port 41*a*, which communicates with the fuel tank 8 (FIG. 1). In a portion of the aforementioned stopper 41 located inside the case 33, there are formed holes 41*b* extending in a radial direction of the stopper 41. An internal space of the stopper 41 is connected to the low-pressure chamber 35 by these holes 41*b*. For this reason, the fuel within the low-pressure chamber 35 is returned to the fuel tank 8 through the holes 41*b* and the outlet port 41*a* of the stopper 41. An end portion of the cylindrical element 38 located inside the case 33 is in a closed state. At this end portion, there is formed a facing surface 42 which faces a downstream opening of the passage 37*a* in the valve body 37. If the valve body 37 is displaced by the force produced by the fuel pressure within the high-pressure chamber 34 as depicted in FIG. 3, for example, the distance between the valve body 37 and the facing surface 42 at that time alters.

Then, if the valve body 37 is displaced in a direction away from the valve seat 39 of the cylindrical element 38 and the distance between the valve body 37 and the facing surface 42 of the stopper 41 becomes 0 owing to the force produced by the fuel pressure within the high-pressure chamber 34, the valve body 37 comes into contact with the facing surface 42 as depicted in FIG. 4. In such a state where the valve body 37 is in contact with the facing surface 42, the fuel is inhibited from flowing from the passage 37*a* in the valve body 37 to the low-pressure chamber 35. Also, during a process (FIG. 3) in which the valve body 37 is separated from the valve seat 39 and comes into contact with the facing surface 42 due to an increase in the fuel pressure within the high-pressure chamber 34, part of the fuel within the fuel pipe 31 is returned to the fuel tank 8 through the inlet port 38*a* and the holes 38*b* in the cylindrical element 38, the high-pressure chamber 34, the passage 37*a* in the valve body 37, the low-pressure chamber 35 and the holes 41*b* and the outlet port 41*a* of the stopper 41. Therefore, the inlet port 38*a*, the holes 38*b*, the high-pressure chamber 34, the passage 37*a*, the low-pressure chamber 35, the holes 41*b*, the outlet port 41*a*, and the like of the pressure regulator 32 function as fuel channels for returning (releasing) the fuel within the fuel pipe 31 back to the fuel tank 8.

Described next is the flow rate of the fuel returned to the fuel tank 8 through the aforementioned fuel channels of the pressure regulator 32.

If the fuel pressure within the fuel pipe 31, that is, the fuel pressure within the high-pressure chamber 34, increases when the valve body 37 of the pressure regulator 32 is at a position depicted in FIG. 2, the valve body 37 is displaced successively to positions depicted in FIGS. 3 and 4 owing to the force produced by the fuel pressure. Thus, the flow rate of the fuel released from within the fuel pipe 31 through the aforementioned fuel channels of the pressure regulator 32, or, expressed differently, the flow rate of the fuel returned from the fuel pipe 31 to the fuel tank 8 through the aforementioned fuel channels, is made variable in accordance with the position of the valve body 37 which is displaced in this fashion.

Figure 5:
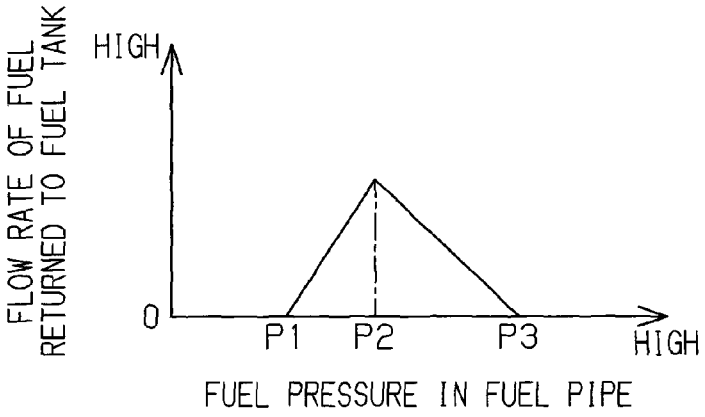
FIG. 5 is a graph indicating a relationship between the fuel pressure within a fuel pipe and the flow rate of fuel returned to a fuel tank through fuel channels of the pressure regulator.
Figure 6:
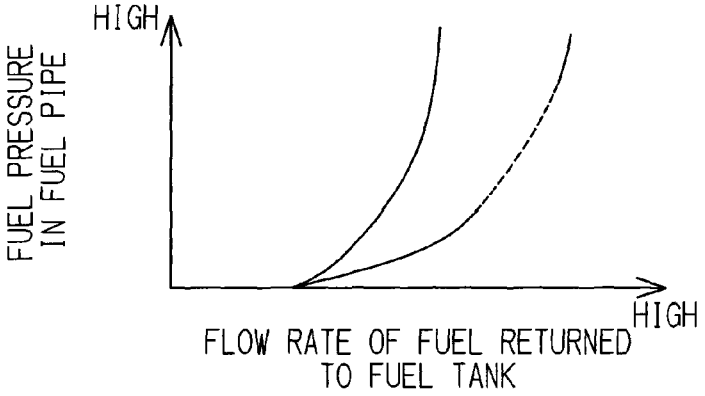
FIG. 6 is a graph indicating a difference in a relationship between the flow rate of the fuel returned from the fuel pipe to the fuel tank through the fuel channels of the pressure regulator and the fuel pressure within the fuel pipe caused by the presence/absence of a constriction.
Figure 7:
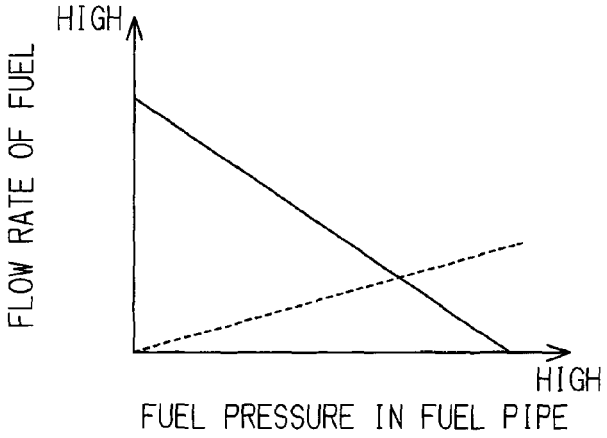
FIG. 7 is a graph indicating a relationship between the fuel pressure within the fuel pipe and the flow rate of the fuel fed from a pump to the fuel pipe as well as a relationship between the fuel pressure within the fuel pipe and the flow rate of the fuel returned from the fuel pipe to the fuel tank through the fuel channels of the pressure regulator.

FIG. 5 indicates the relationship between the fuel pressure within the fuel pipe 31 and the flow rate of the fuel returned to the fuel tank 8 through the aforementioned fuel channels. As indicated in the drawing, when the fuel pressure within the fuel pipe 31 becomes higher than or equal to a value P1, the flow rate of the fuel returned to the fuel tank 8 through the aforementioned fuel channels gradually increases.

Then, when the fuel pressure within the fuel pipe 31 increases up to a value P2, which is higher than the value P1, the flow rate of the fuel returned to the fuel tank 8 through the aforementioned fuel channels reaches a maximum value. When the fuel pressure within the fuel pipe 31 becomes higher than or equal to the value P2 subsequently, the flow rate of the fuel returned to the fuel tank 8 through the aforementioned fuel channels gradually decreases. Then, when the fuel pressure within the fuel pipe 31 becomes higher than or equal to a value P3 which is higher than the value P2, the flow rate of the fuel returned to the fuel tank 8 through the aforementioned fuel channels is set to 0.

During a process in which the fuel pressure within the fuel pipe 31 reaches from the value P1 to the value P2, the valve body 37 of the pressure regulator 32 is displaced from the position where the valve body 37 is in contact with the valve seat 39 (FIG. 2) to a position that is intermediate between the valve seat 39 and the stopper 41 (the facing surface 42) (FIG. 3). In this case, the fuel flow area of an upstream portion of the passage 37*a* among the aforementioned fuel channels of the pressure regulator 32 gradually increases due to the aforementioned displacement of the valve body 37 and, as a result, the flow rate of the fuel returned to the fuel tank 8 through the aforementioned fuel channels gradually increases. Also, during a process in which the fuel pressure within the fuel pipe 31 reaches from the value P2 to the value P3, the valve body 37 of the pressure regulator 32 is displaced from a position that is intermediate between the valve seat 39 and the stopper 41 (the facing surface 42) (FIG. 3) to a position where the valve body 37 is in contact with the facing surface 42 (FIG. 4). In this case, the fuel flow area of a downstream portion of the passage 37*a* among the aforementioned fuel channels of the pressure regulator 32 gradually decreases due to the aforementioned displacement of the valve body 37 and, as a result, the flow rate of the fuel returned to the fuel tank 8 through the aforementioned fuel channels gradually decreases until the flow rate reaches 0.

Therefore, when the fuel pressure within the fuel pipe 31 is high, and more specifically, when the fuel pressure is higher than or equal to the value P2 indicated in FIG. 5, the fuel flow area of the aforementioned fuel channels of the pressure regulator 32 is reduced as described above, and this makes it possible to decrease the flow rate of the fuel returned from the fuel pipe 31 to the fuel tank 8 through the aforementioned fuel channels. In other words, it becomes possible to decrease the flow rate of the fuel when the fuel within the fuel pipe 31 is released through the aforementioned fuel channels. As a result, the fuel within the fuel pipe 31 becomes less likely to be released through the aforementioned fuel channels. As the fuel within the fuel pipe 31 becomes less likely to be released through the aforementioned fuel channels of the pressure regulator 32 as stated above, it is possible to correspondingly increase the fuel pressure within the fuel pipe 31 in an efficient manner when an attempt is made to increase the fuel delivery rate of the feed pump 9 by increasing the operating rate of the pump 9 under conditions where the fuel pressure within the fuel pipe 31 is high.

Also, there is formed the constriction 30 within the passage 37*a* in the valve body 37 of the pressure regulator 32 for reducing the flow area through which the fuel passes. If there is not formed the aforementioned constriction 30 within the passage 37*a* in the valve body 37, a situation is created where the flow rate of the fuel returned from the fuel pipe 31 to the fuel tank 8 through the aforementioned fuel channels of the pressure regulator 32 and the fuel pressure within the fuel pipe 31 have a relationship represented by the broken line of FIG. 6 when the operating rate of the feed pump 9 is increased. In this case, the flow rate of the fuel that flows from within the fuel pipe 31 through the aforementioned fuel channels of the pressure regulator 32 increases and, therefore, the fuel pressure within the fuel pipe 31 does not increase with good responsiveness even if the operating rate of the feed pump 9 is increased. In contrast, if the aforementioned constriction 30 is formed within the passage 37*a* in the valve body 37, there will be created a situation where the flow rate of the fuel returned from the fuel pipe 31 to the fuel tank 8 through the aforementioned fuel channels of the pressure regulator 32 and the fuel pressure within the fuel pipe 31 have a relationship represented by a solid line of FIG. 6 when the operating rate of the feed pump 9 is increased. In this case, the flow rate of the fuel that flows from within the fuel pipe 31 through the aforementioned fuel channels of the pressure regulator 32 decreases and, therefore, the fuel pressure within the fuel pipe 31 increases with good responsiveness when the operating rate of the feed pump 9 is increased.

According to the present embodiment thus far described in detail, it becomes possible to achieve the following advantages.

(1) The pressure regulator 32 is provided with the stopper 41, which can come into contact with the valve body 37 when the valve body 37 is displaced as a result of an increase in the fuel pressure within the fuel pipe 31. The stopper 41 is so configured as to reduce the fuel flow area of the aforementioned fuel channels of the pressure regulator 32 as a result of a displacement of the valve body 37 caused by the increase in the fuel pressure within the fuel pipe 31. Therefore, when the fuel pressure within the fuel pipe 31 is high, the fuel flow area of the aforementioned fuel channels is reduced as described above, and this makes it possible to decrease the flow rate of the fuel when the fuel within the fuel pipe 31 is released through the aforementioned fuel channels. In other words, the fuel within the fuel pipe 31 becomes less likely to be released through the aforementioned fuel channels. As the fuel within the fuel pipe 31 becomes less likely to be released through the aforementioned fuel channels as stated above, it is possible to correspondingly increase the fuel pressure within the fuel pipe 31 in an efficient manner when an attempt is made to increase the fuel delivery rate of the feed pump 9 by increasing the operating rate of the pump 9 under conditions where the fuel pressure within the fuel pipe 31 is high. Therefore, it becomes possible to prevent an increase in energy consumption when making an attempt to increase the fuel pressure within the fuel pipe 31 by operating the feed pump 9 under conditions where the fuel pressure is high. Also, it becomes unnecessary to increase the feed pump 9 in size in order to increase the fuel delivery rate thereof for the purpose of increasing the fuel pressure within the fuel pipe 31 under conditions where the fuel pressure is high.

(2) Inside the valve body 37 of the pressure regulator 32, there is formed the passage 37*a*, which constitutes part of the aforementioned fuel channels and the aforementioned stopper 41 is provided downstream of the passage 37*a*. Then, in the aforementioned passage 37*a* of the valve body 37, there is formed the constriction 30 for reducing the flow area through which the fuel passes. With the constriction 30 formed in the aforementioned passage 37*a* of the valve body 37 as stated above, the flow rate of the fuel that flows from within the fuel pipe 31 through the aforementioned fuel channels decreases and, therefore, the fuel pressure within the fuel pipe 31 increases with good responsiveness when the operating rate of the feed pump 9 is increased.

(3) The stopper 41 is provided downstream of the passage 37*a* of the valve body 37 and is configured to include the facing surface 42, which faces the downstream opening of the passage 37*a*. As the distance between the downstream opening of the aforementioned passage 37*a* and the aforementioned facing surface 42 is decreased when the valve body 37 is displaced as a result of an increase in the fuel pressure within the fuel pipe 31, the stopper 41 serves to reduce the fuel flow area of the downstream portion of the aforementioned passage 37*a* among the aforementioned fuel channels of the pressure regulator 32. With this arrangement, the fuel flow area of the downstream portion of the aforementioned passage 37*a* among the aforementioned fuel channels is reliably reduced in the event of the aforementioned displacement of the valve body 37.

(4) The cylindrical element 38 and the stopper 41 of the pressure regulator 32 are fixed by press-fitting the same into the case 33. For this reason, it is possible to adjust the position of the valve seat 39 of the cylindrical element 38 and that of the facing surface 42 of the stopper 41 in a direction of displacement of the valve body 37 by adjusting the amount of press fit (press-fitting position) of the cylindrical element 38 and the stopper 41 with respect to the case 33. Then, it is possible to determine the value P1 (FIG. 5) of the fuel pressure within the fuel pipe 31 that is effective when the valve body 37 is separated from the valve seat 39 through adjustment of the position of the aforementioned valve seat 39. It is also possible to determine the value P3 (FIG. 5) of the fuel pressure within the fuel pipe 31 that is effective when the valve body 37 comes into contact with the facing surface 42 through adjustment of the position of the aforementioned facing surface 42.

It is possible to modify the aforementioned embodiment in the below-described fashion, for example.

The constriction 30 does not need to be formed within the passage 37*a* in the valve body 37.

The present invention may be applied to a pressure regulator provided in a fuel supply system mounted on other than the engine 1 for an automobile.

DESCRIPTION OF THE REFERENCE NUMERALS

1. Engine
2. Intake passage
3. Combustion chamber
6. Injector
7. Fuel supply system
8. Fuel tank
9. Feed pump
13. Piston
14. Crankshaft
15. Exhaust passage
16. Electronic control unit
23. Pressure sensor
30. Constriction
31. Fuel pipe
32. Pressure regulator
33. Case
34. High-pressure chamber
35. Low-pressure chamber
36. Diaphragm
37. Valve body

37*a*. Passage
38. Cylindrical element
38*a*. Inlet port
38*b*. Holes
39. Valve seat
40. Coil spring
41. Stopper
41*a*. Outlet port
41*b*. Holes
42. Facing surface

The invention claimed is:

1. A pressure regulator comprising:

a moving part which is displaced by force produced by fuel pressure within a fuel pipe that is regulated by operating a pump, wherein, when fuel is released from within the fuel pipe through a fuel channel, the flow rate of the released fuel is varied in accordance with the position of the moving part; and a stopper, which can come into contact with the moving part when the moving part is displaced as a result of an increase in the fuel pressure, wherein the stopper reduces fuel flow area of the fuel channel as a result of a displacement of the moving part caused by an increase in the fuel pressure.

2. The pressure regulator as recited in claim 1, wherein a passage, which constitutes a part of the fuel channel, is formed inside the moving part, the stopper is provided downstream of the passage, the stopper reducing a fuel flow area of a downstream portion of the passage of the fuel channel when the moving part is displaced as a result of an increase in the fuel pressure, and the passage of the moving part is provided with a constriction for reducing the fuel flow area through which the fuel passes.

3. The pressure regulator as recited in claim 1, wherein a passage, which constitutes part of the fuel channel, is formed inside the moving part, the stopper is provided downstream of the passage and includes a facing surface, which faces a downstream opening of the passage, and the distance between the downstream opening of the passage and the facing surface is decreased when the moving part is displaced as a result of an increase in the fuel pressure, thereby reducing fuel flow area of a downstream portion of the passage of the fuel channel.

* * * * *